US011174767B2

(12) United States Patent
Suzuki

(10) Patent No.: US 11,174,767 B2
(45) Date of Patent: Nov. 16, 2021

(54) AIR EXHAUSTING DEVICE

(71) Applicant: SUZUKI MOTOR CORPORATION, Hamamatsu (JP)

(72) Inventor: Kenta Suzuki, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 576 days.

(21) Appl. No.: 16/113,688

(22) Filed: Aug. 27, 2018

(65) Prior Publication Data

US 2019/0063282 A1 Feb. 28, 2019

(30) Foreign Application Priority Data

Aug. 31, 2017 (JP) ..... JP2017-167698

(51) Int. Cl.
*F01N 1/08* (2006.01)
*F01N 1/02* (2006.01)

(52) U.S. Cl.
CPC ..... *F01N 1/083* (2013.01); *F01N 1/084* (2013.01); *F01N 1/089* (2013.01);
(Continued)

(58) Field of Classification Search
CPC ... F01N 1/00; F01N 1/003; F01N 1/02; F01N 1/084; F01N 1/089; F01N 1/08;
(Continued)

(56) References Cited

U.S. PATENT DOCUMENTS 3,103,256 A * 9/1963 Deremer ..... F01N 1/02 181/266
3,107,748 A * 10/1963 Arthur ..... F01N 13/185 181/245

(Continued)

FOREIGN PATENT DOCUMENTS

FR 2422824 A1 * 11/1979 ..... F01N 1/084
JP 4-95609 U 8/1992

(Continued)

OTHER PUBLICATIONS

Notification of Reasons for Refusal issued in Japanese Patent Application No. 2017-167698 dated Jun. 29, 2021, with machine translation.

*Primary Examiner* — Edgardo San Martin
(74) *Attorney, Agent, or Firm* — Troutman Pepper Hamilton Sanders LLP

(57) ABSTRACT

An air exhausting device includes an inlet pipe that couples an exhaust pipe of an engine to a muffler, an outlet pipe that is a path to discharge an exhaust gas inside the muffler to outside air, and the muffler divided into a plurality of chambers by separators. The muffler is configured of a first expansion chamber, a second expansion chamber with which the outlet pipe is communicated, and a third expansion chamber. The inlet pipe is communicated with the first expansion chamber. The outlet pipe is communicated with the second expansion chamber. The first expansion chamber is adjacent to and communicated with the second expansion chamber via a first pipe. The second expansion chamber is communicated with the third expansion chamber via a second pipe. The first expansion chamber is communicated with the third expansion chamber via a third pipe.

8 Claims, 3 Drawing Sheets

(52) U.S. Cl.
CPC ..... *F01N 2490/02* (2013.01); *F01N 2490/06* (2013.01); *F01N 2490/10* (2013.01)

(58) Field of Classification Search
CPC ..... F01N 2490/02; F01N 2490/06; F01N 2490/15; F01N 2490/155
See application file for complete search history.

(56) References Cited

U.S. PATENT DOCUMENTS 3,289,786 A * 12/1966 Powers ..... F01N 1/02 181/266
3,741,336 A * 6/1973 Malosh ..... F01N 1/02 181/266
4,079,808 A * 3/1978 Mizuno ..... F01N 1/166 181/237
4,177,875 A * 12/1979 Kurobe ..... F01N 1/02 181/265
4,846,302 A * 7/1989 Hetherington ..... F01N 1/10 181/243
4,971,166 A * 11/1990 Hase ..... F01N 1/02 181/254
5,614,699 A * 3/1997 Yashiro ..... F01N 1/02 181/254
5,739,483 A * 4/1998 Yashiro ..... F01N 1/02 181/254
5,801,343 A 9/1998 Suzuki et al.
5,801,344 A * 9/1998 Herold ..... F01N 1/02 181/265
5,971,098 A * 10/1999 Suzuki ..... F01N 1/02 181/254
5,984,045 A * 11/1999 Maeda ..... F01N 1/02 181/254
6,176,347 B1 * 1/2001 Chae ..... F01N 1/165 181/254
8,646,572 B2 * 2/2014 Uchino ..... F01N 13/082 181/228
8,991,553 B2 * 3/2015 Wakatsuki ..... F01N 1/08 181/268
2002/0029807 A1 3/2002 Nagai et al.
2006/0086563 A1 * 4/2006 Lucas ..... F01N 1/089 181/230
2013/0087405 A1 4/2013 Uchino et al.
2019/0063281 A1 * 2/2019 Suzuki ..... F01N 13/08
2019/0195099 A1 * 6/2019 Tomobe ..... F01N 1/089

FOREIGN PATENT DOCUMENTS

JP 10131738 A * 5/1998 ..... F01N 1/166
JP 10-227208 A 8/1998
JP 2002-89257 A 3/2002
JP 2007205275 A 8/2007
JP 2013-83161 A 5/2013
KR 20090049201 A * 5/2009
WO 95/13460 A1 5/1995

* cited by examiner

AIR EXHAUSTING DEVICE

CROSS-REFERENCE TO RELATED APPLICATIONS

This application is based upon and claims the benefit of priority of the prior Japanese Patent Application No. 2017-167698, filed on Aug. 31, 2017, the entire contents of which are incorporated herein by reference.

BACKGROUND OF THE INVENTION

Field of the Invention

The present invention typically relates to an air exhausting device coupled to an engine of a motorcycle.

Description of the Related Art

Conventionally, for example, a muffler disclosed in Patent Document 1 includes a pipe-shaped muffler shell, an inlet pipe that introduces an exhaust gas into this muffler shell, and an outlet pipe that discharges the exhaust gas inside this muffler shell to the outside. The inlet pipe is inserted into this muffler shell from an end plate at one end of the muffler shell, and the outlet pipe is derived from an end plate at another end.

Patent Document 1: Japanese Laid-open Patent Publication No. 2007-205275

The conventional example as described above ensures silencing effect from a low-frequency range to a high-frequency range. However, it is substantially difficult to ensure reduction in exhaust gas pressure. Therefore, it is actually impossible to ensure the silencing effect and improvement in engine output at the same time.

SUMMARY OF THE INVENTION

To solve the actual conditions, an object of the present invention is to provide an air exhausting device that effectively ensures improvement in engine output and silencing effect at the same time.

An air exhausting device of the present invention includes an inlet pipe that couples an exhaust pipe of an engine to a muffler, an outlet pipe that is a path to discharge an exhaust gas inside the muffler to outside air, and the muffler divided into a plurality of chambers by a separator. The muffler is configured of a first expansion chamber, a second expansion chamber with which the outlet pipe is communicated, and a third expansion chamber. The inlet pipe is communicated with the first expansion chamber. The outlet pipe is communicated with the second expansion chamber. The first expansion chamber is adjacent to and communicated with the second expansion chamber via a first pipe. The second expansion chamber is communicated with the third expansion chamber via a second pipe. The first expansion chamber is communicated with the third expansion chamber via a third pipe.

DETAILED DESCRIPTION OF THE PREFERRED EMBODIMENTS

The following describes preferred embodiments of an air exhausting device according to the present invention based on the drawings. An air exhausting device built into an engine of a motorcycle is exemplified as an application example of the present invention.

An air exhausting device according to one embodiment of the present invention includes an inlet pipe that couples an exhaust pipe of an engine to a muffler, an outlet pipe that is a path to discharge an exhaust gas inside the muffler to outside air, and the muffler divided into a plurality of chambers by a separator. The muffler is configured of a first expansion chamber, a second expansion chamber with which the outlet pipe is communicated, and a third expansion chamber. The inlet pipe is communicated with the first expansion chamber. The outlet pipe is communicated with the second expansion chamber. The first expansion chamber is adjacent to and communicated with the second expansion chamber via a first pipe. The second expansion chamber is communicated with the third expansion chamber via a second pipe. The first expansion chamber is communicated with the third expansion chamber via a third pipe.

In the air exhausting device of the present invention, in combination of two exhaust paths having different path lengths ensures an effect of reduction in exhaust gas pressure and an effect of reduction in exhaust noise at the same time.

First Embodiment

Figure 1:
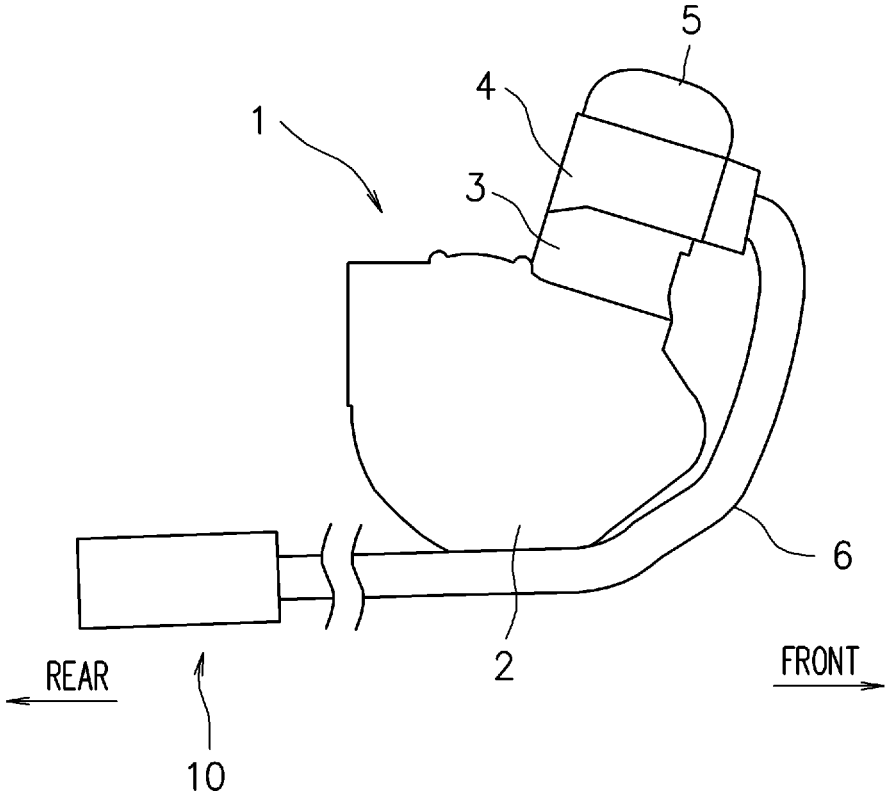
FIG. 1 is a right side view illustrating a periphery of an air exhausting device built into a motorcycle as an application example of the present invention.

Including FIG. 1, drawings referred to in the following description define a direction that a rider who has ridden a motorcycle views a front of the vehicle as a front and a direction opposite to the front as a rear. The right side of the rider is defined as the right and the left side as the left. These respective directions are appropriately indicated by arrows as necessary. FIG. 1 is a right side view illustrating a periphery of an air exhausting device 10 built into an engine 1 mounted on a motorcycle as an application example of the present invention.

The motorcycle including the air exhausting device 10 in the first embodiment forms a framework of vehicle body with a vehicle body frame made of steel or of aluminum alloy. In FIG. 1, this vehicle body frame supports the engine 1 at an approximately center of the vehicle body. The engine 1 is, for example, a four-cycle single cylinder (may be a two-cylinder or more) engine. The engine 1 may be a water-cooled engine or an air-cooled engine. This engine 1 has a basic configuration including a crankcase 2 and a cylinder block 3. The crankcase 2 rotatably supports and houses a crankshaft arranged horizontally in a right-left direction. The cylinder block 3 is coupled with an upper portion of the crankcase 2 and has an axis line that is appropriately inclined ahead to be set in an approximately vertical direction. The engine 1 is configured further including a cylinder head 4 and a cylinder head cover 5. The cylinder head 4 is coupled with an upper portion of the cylinder block 3. The cylinder head cover 5 is attached to and lids the cylinder head 4.

The engine 1 includes an air intake system where air purified by an air cleaner (not illustrated) is supplied to the engine 1 via an intake passage. In this case, a mixture at a predetermined mixing ratio formed of air and fuel is supplied from a throttle body arranged on the middle of the intake passage to an intake port (not illustrated) disposed on a back portion of the cylinder head 4. A combustion gas that has exploded and combusted inside the cylinder block 3 of the engine 1 in an exhaust system is discharged from the engine 1. That is, the combustion gas generated inside the engine 1, as an exhaust gas, passes through an exhaust pipe 6 coupled to an exhaust port (not illustrated) of the engine 1. Then, the combustion gas is discharged to the outside air from the air exhausting device 10 coupled to the exhaust pipe 6.

Figure 2:
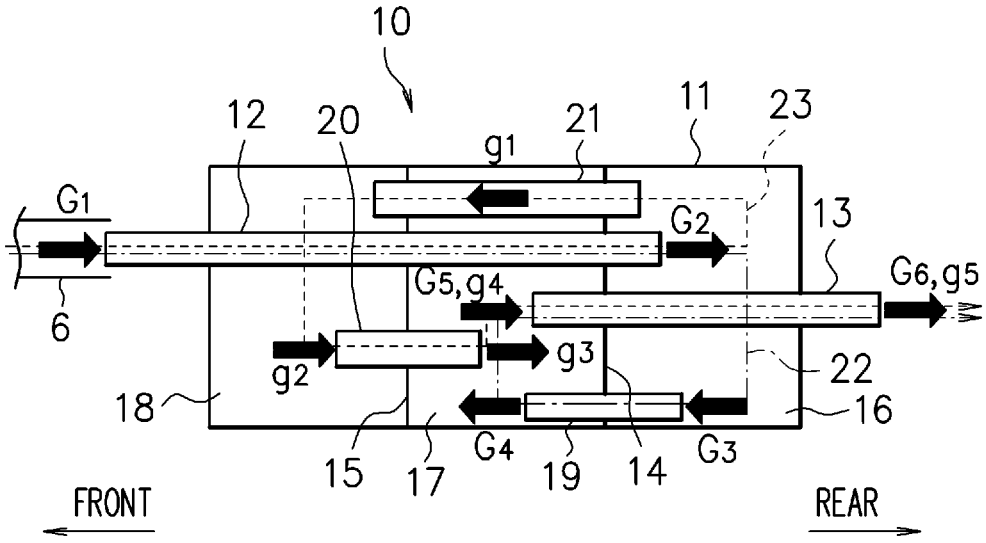
FIG. 2 is a cross-sectional view along a longitudinal direction schematically illustrating an exemplary internal structure of an air exhausting device in a first embodiment of the present invention.

Next, FIG. 2 is a cross-sectional view along a longitudinal direction schematically illustrating an exemplary internal structure of the air exhausting device 10 in the first embodiment. The air exhausting device 10 includes an inlet pipe 12 and an outlet pipe 13. The inlet pipe 12 couples the exhaust pipe 6 of the engine 1 (FIG. 1) to a muffler 11. The outlet pipe 13 is a path to discharge the exhaust gas inside the muffler 11 to the outside air. In this embodiment, the muffler 11 has a longitudinal direction set in a front-rear direction. However, an arrangement direction of the muffler 11 is changeable as necessary.

In this embodiment, the muffler 11 is divided into a plurality of chambers by separators 14 and 15.

The muffler 11 is divided by the separators 14 and 15 to be configured of a first expansion chamber 16, a second expansion chamber 17, and a third expansion chamber 18. The outlet pipe 13 is communicated with the second expansion chamber 17.

In this case, the inlet pipe 12 is communicated with the first expansion chamber 16. The outlet pipe 13 is communicated with the second expansion chamber 17.

In this embodiment, especially, the first expansion chamber 16 is adjacent to and communicated with the second expansion chamber 17 via a first pipe 19.

The second expansion chamber 17 is communicated with the third expansion chamber 18 via a second pipe 20.

The first expansion chamber 16 is communicated with the third expansion chamber 18 via a third pipe 21.

With reference to FIG. 2, in the air exhausting device 10 of the present invention, the combustion gas generated inside the engine 1, as the exhaust gas, flows from the exhaust pipe 6 as an arrow $G_1$ via the inlet pipe 12 into the first expansion chamber 16 (an arrow $G_2$). A part of the exhaust gas that has flowed into the first expansion chamber 16 passes through the first pipe 19 as an arrow $G_3$ to flow into the second expansion chamber 17 (an arrow $G_4$) along an exhaust path 22 indicated by the one dot chain line in FIG. 2. Further, this exhaust gas flows into the outlet pipe 13 (an arrow $G_5$) to be discharged from the air exhausting device 10 through the outlet pipe 13 to the outside air (an arrow $G_6$).

A part of the exhaust gas that has flowed into the first expansion chamber 16 flows into the third expansion chamber 18 via the third pipe 21 as an arrow $g_1$, along an exhaust path 23 indicated by the dotted line in FIG. 2. Then, the exhaust gas flows into the second pipe 20 (an arrow $g_2$) to flow into the second expansion chamber 17 via the second pipe 20 (an arrow $g_3$). Further, this exhaust gas flows into the outlet pipe 13 (an arrow $g_4$) to be discharged from the air exhausting device 10 through the outlet pipe 13 to the outside air (an arrow $g_5$).

In the first embodiment, the exhaust gas discharged from the engine 1 flows into the first expansion chamber 16 from the exhaust pipe 6 via the inlet pipe 12. Then, the exhaust gas branches off to the exhaust path 22 and to the exhaust path 23. Both are finally discharged to the outside air from the air exhausting device 10. The exhaust path 22 has a path length shorter than a path length of the exhaust path 23. An exhaust path 22 side contributes to reduction in exhaust gas pressure. On the other hand, an exhaust path 23 side whose path length is long contributes to reduction in exhaust noise. Such a combination of the two exhaust path 22 and exhaust path 23 having different path lengths, that is, a separate disposition of the exhaust path 22 having an effect of the reduction in exhaust gas pressure and the exhaust path 23 having an effect of the reduction in exhaust noise ensures effects of the reduction in the exhaust gas pressure (increase in engine output) and the reduction in exhaust noise at the same time in the muffler 11.

In the above-described case, adjusting diameters and lengths of the respective pipes ensures reduction in sound of a wavelength that is a target.

It is estimated that the exhaust noise is reduced such that a phase difference occurs in sound waves passing through different exhaust paths.

It is also estimated that the effect of the reduction in exhaust noise is ensured such that energy of the exhaust noise attenuates by occurrence of a difference in air pressure between inside the respective pipes and inside the respective expansion chambers and reflected sound inside the expansion chamber.

Further, in a cross-sectional view of the muffler 11, as the respective pipes in the respective expansion chambers are arranged more adjacent to one another, the exhaust gas preferentially flows.

Similarly, in the cross-sectional view, as a difference in amounts of projection between end parts of the respective pipes in the respective expansion chambers is small, the exhaust gas preferentially flows.

Second Embodiment

Figure 3:
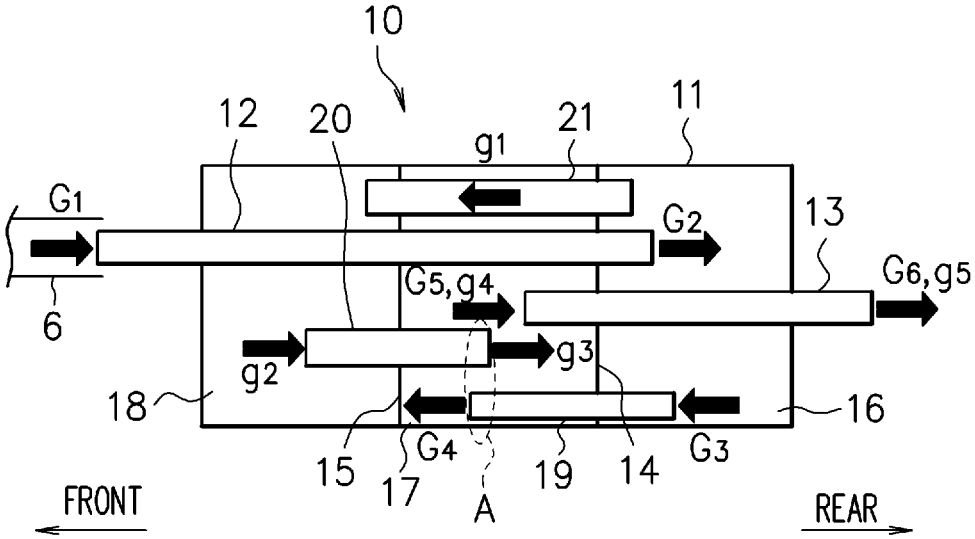
FIG. 3 is a cross-sectional view along a longitudinal direction schematically illustrating an exemplary internal structure of an air exhausting device in a second embodiment of the present invention.

The following describes a second embodiment of the air exhausting device 10 according to the present invention. FIG. 3 is a cross-sectional view along a longitudinal direction schematically illustrating an exemplary internal structure of an air exhausting device 10 in the second embodiment. Members identical to or corresponding to those in the case of the first embodiment are described using identical reference numerals.

In the second embodiment, in a cross section along a longitudinal direction of the muffler 11, the first pipe 19 is adjacent to the second pipe 20 such that their distal ends overlap one another in the longitudinal direction inside the second expansion chamber 17 (an area A indicated by the dotted line in FIG. 3).

With reference to FIG. 3, in the air exhausting device 10 of the present invention, the combustion gas generated inside the engine 1, as the exhaust gas, flows as an arrow $G_1$ via the inlet pipe 12 into the first expansion chamber 16 (an arrow $G_2$). A part of the exhaust gas that has flowed into the first expansion chamber 16 passes through the first pipe 19 as an arrow $G_3$ to flow into the second expansion chamber 17 (an arrow $G_4$). Further, this exhaust gas flows into the outlet pipe 13 (an arrow $G_5$) to be discharged from the air exhausting device 10 through the outlet pipe 13 to the outside air (an arrow $G_6$).

A part of the exhaust gas that has flowed into the first expansion chamber 16 flows into the third expansion chamber 18 via the third pipe 21 as an arrow $g_1$. Then, this exhaust gas flows into the second pipe 20 (an arrow $g_2$) to flow into the second expansion chamber 17 via the second pipe 20 (an arrow $g_3$). Further, this exhaust gas flows into the outlet pipe 13 (an arrow $g_4$) to be discharged from the air exhausting device 10 through the outlet pipe 13 to the outside air (an arrow $g_5$).

In the second embodiment, the first pipe 19 is adjacent to the second pipe 20 such that their distal ends overlap one another in the longitudinal direction. Thus, the exhaust gas that has passed through the first pipe 19 whose flow rate is fast collides with the separator 15 to prevent the flow into the third expansion chamber 18. This ensures a muffler structure that centers on the reduction in exhaust gas pressure.

Third Embodiment

Figure 4:
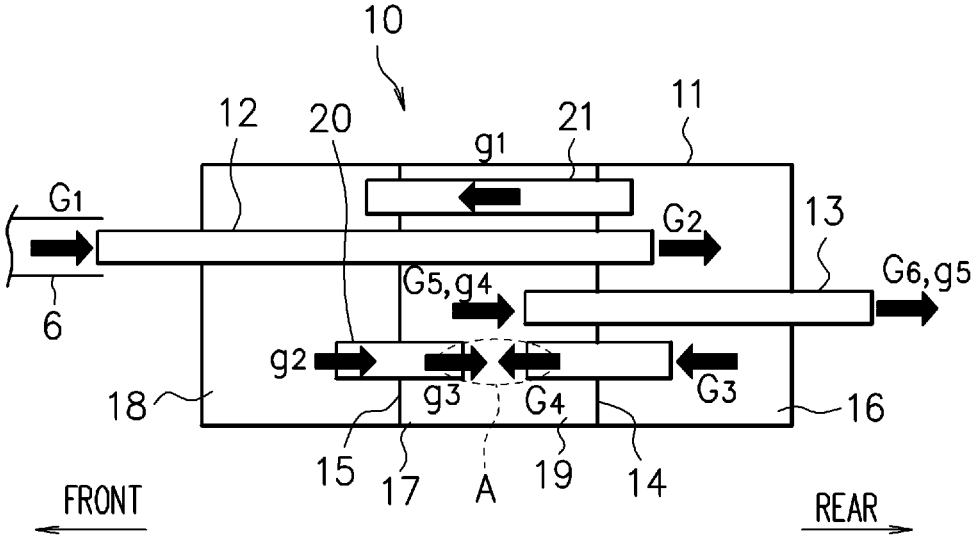
FIG. 4 is a cross-sectional view along a longitudinal direction schematically illustrating an exemplary internal structure of an air exhausting device in a third embodiment of the present invention.

The following describes a third embodiment of the air exhausting device 10 according to the present invention. FIG. 4 is a cross-sectional view along a longitudinal direction schematically illustrating an exemplary internal structure of an air exhausting device 10 in the third embodiment. Members identical to or corresponding to those in the case of the first embodiment are described using identical reference numerals.

In the third embodiment, in a cross section along a longitudinal direction of the muffler 11, the first pipe 19 and the second pipe 20 are arranged at positions where their distal ends are approximately faced to one another in the longitudinal direction inside the second expansion chamber 17 (an area A indicated by the dotted line in FIG. 4).

With reference to FIG. 4, in the air exhausting device 10 of the present invention, the combustion gas generated inside the engine 1, as the exhaust gas, flows as an arrow $G_1$ via the inlet pipe 12 into the first expansion chamber 16 (an arrow $G_2$). A part of the exhaust gas that has flowed into the first expansion chamber 16 passes through the first pipe 19 as an arrow $G_3$ to flow into the second expansion chamber 17 (an arrow $G_4$). Further, this exhaust gas flows into the outlet pipe 13 (an arrow $G_5$) to be discharged from the air exhausting device 10 through the outlet pipe 13 to the outside air (an arrow $G_6$).

A part of the exhaust gas that has flowed into the first expansion chamber 16 flows into the third expansion chamber 18 via the third pipe 21 as an arrow $g_1$. Then, this exhaust gas flows into the second pipe 20 (an arrow $g_2$) to flow into the second expansion chamber 17 via the second pipe 20 (an arrow $g_3$). Further, this exhaust gas flows into the outlet pipe 13 (an arrow $g_4$) to be discharged from the air exhausting device 10 through the outlet pipe 13 to the outside air (an arrow $g_5$).

In the third embodiment, the first pipe 19 and the second pipe 20 are arranged at the positions where their distal ends are approximately faced to one another in the longitudinal direction. Thus, the exhaust gas that has passed through the first pipe 19 whose flow rate is fast collides with the exhaust air that has passed through the second pipe 20 whose flow rate is slow to flow into the third expansion chamber 18. This ensures a muffler structure that centers on the reduction in exhaust noise.

Fourth Embodiment

Figure 5:
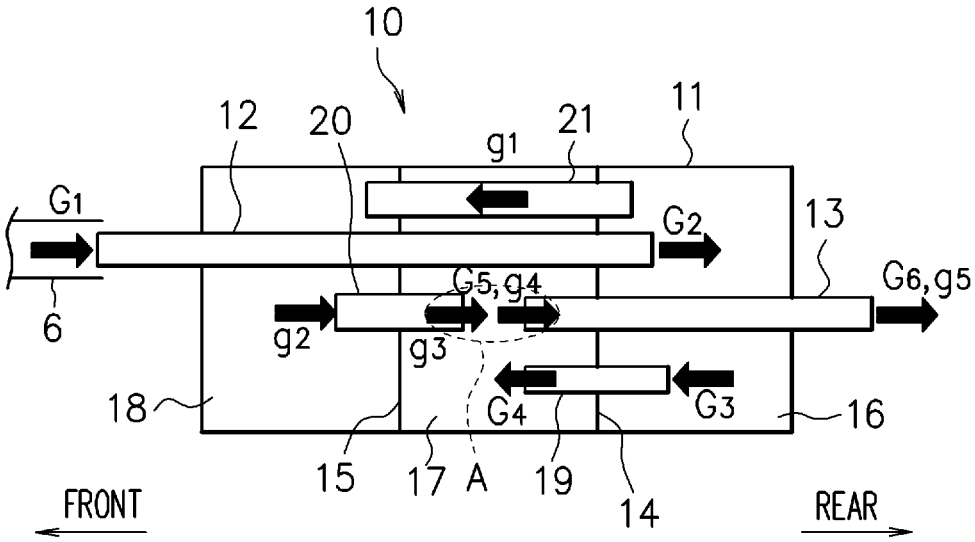
FIG. 5 is a cross-sectional view along a longitudinal direction schematically illustrating an exemplary internal structure of an air exhausting device in a fourth embodiment of the present invention.

The following describes a fourth embodiment of the air exhausting device 10 according to the present invention. FIG. 5 is a cross-sectional view along a longitudinal direction schematically illustrating an exemplary internal structure of an air exhausting device 10 in the fourth embodiment. Members identical to or corresponding to those in the case of the first embodiment are described using identical reference numerals.

In the fourth embodiment, in a cross section along a longitudinal direction of the muffler 11, the second pipe 20 and the outlet pipe 13 are arranged at positions where their distal ends are approximately faced to one another in the longitudinal direction inside the second expansion chamber 17 (an area A indicated by the dotted line in FIG. 5).

With reference to FIG. 5, in the air exhausting device 10 of the present invention, the combustion gas generated inside the engine 1, as the exhaust gas, flows as an arrow $G_1$ via the inlet pipe 12 into the first expansion chamber 16 (an arrow $G_2$). A part of the exhaust gas that has flowed into the first expansion chamber 16 passes through the first pipe 19 as an arrow $G_3$ to flow into the second expansion chamber 17 (an arrow $G_4$). Further, this exhaust gas flows into the outlet pipe 13 (an arrow $G_5$) to be discharged from the air exhausting device 10 through the outlet pipe 13 to the outside air (an arrow $G_6$).

A part of the exhaust gas that has flowed into the first expansion chamber 16 flows into the third expansion chamber 18 via the third pipe 21 as an arrow $g_1$. Then, this exhaust gas flows into the second pipe 20 (an arrow $g_2$) to flow into the second expansion chamber 17 via the second pipe 20 (an arrow $g_3$). Further, this exhaust gas flows into the outlet pipe 13 (an arrow $g_4$) to be discharged from the air exhausting device 10 through the outlet pipe 13 to the outside air (an arrow $g_5$).

In the fourth embodiment, the second pipe 20 and the outlet pipe 13 are arranged at the positions where their distal ends are approximately faced to one another in the longitudinal direction. Thus, the exhaust gas easily flows into the outlet pipe 13 from the second pipe 20. This ensures a muffler structure that centers on the reduction in exhaust gas pressure.

Fifth Embodiment

Figure 6:
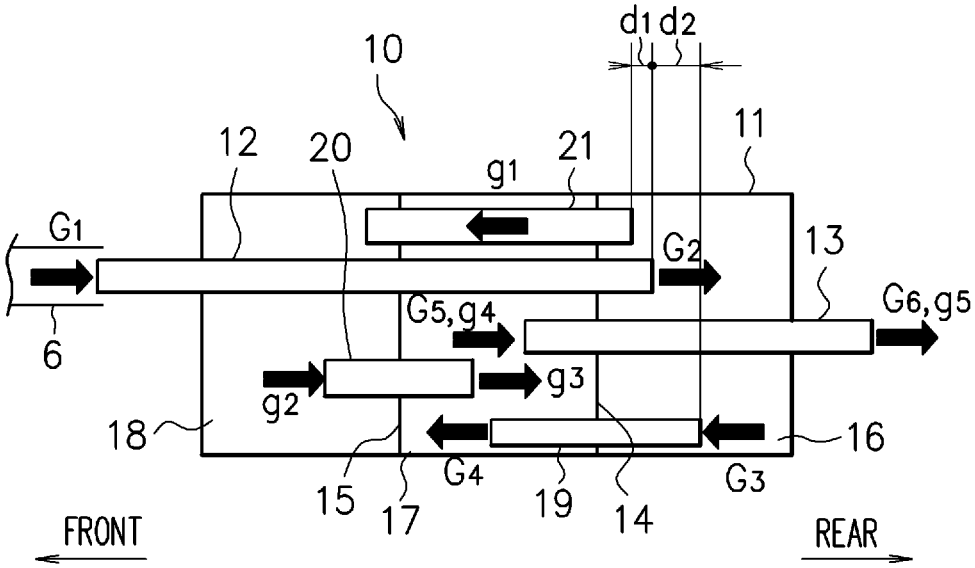
FIG. 6 is a cross-sectional view along a longitudinal direction schematically illustrating an exemplary internal structure of an air exhausting device in a fifth embodiment of the present invention.

The following describes a fifth embodiment of the air exhausting device 10 according to the present invention. FIG. 6 is a cross-sectional view along a longitudinal direction schematically illustrating an exemplary internal structure of an air exhausting device 10 in the fifth embodiment. Members identical to or corresponding to those in the case of the first embodiment are described using identical reference numerals.

In the fifth embodiment, in a cross section along a longitudinal direction of the muffler 11, the inlet pipe 12 is adjacent to and between the third pipe 21 and the outlet pipe 13.

In this case, a difference $d_1$ in amounts of projection from the separator 14 of respective end portions of the third pipe 21 and the inlet pipe 12 inside the first expansion chamber 16 is set smaller than a difference $d_2$ in amounts of projection from the separator 14 of respective end portions of the first pipe 19 and the inlet pipe 12 inside the first expansion chamber 16.

With reference to FIG. 6, in the air exhausting device 10 of the present invention, the combustion gas generated inside the engine 1, as the exhaust gas, flows as an arrow $G_1$ via the inlet pipe 12 into the first expansion chamber 16 (an arrow $G_2$). A part of the exhaust gas that has flowed into the first expansion chamber 16 passes through the first pipe 19 as an arrow $G_3$ to flow into the second expansion chamber 17 (an arrow $G_4$). Further, this exhaust gas flows into the outlet pipe 13 (an arrow $G_5$) to be discharged from the air exhausting device 10 through the outlet pipe 13 to the outside air (an arrow $G_6$).

A part of the exhaust gas that has flowed into the first expansion chamber 16 flows into the third expansion chamber 18 via the third pipe 21 as an arrow $g_1$. Then, this exhaust gas flows into the second pipe 20 (an arrow $g_2$) to flow into the second expansion chamber 17 via the second pipe 20 (an arrow $g_3$). Further, this exhaust gas flows into the outlet pipe 13 (an arrow $g_4$) to be discharged from the air exhausting device 10 through the outlet pipe 13 to the outside air (an arrow $g_5$).

In the fifth embodiment, the difference $d_1$ in the amounts of projection of the third pipe 21 and the inlet pipe 12 is set smaller than the difference $d_2$ in the amounts of projection of the first pipe 19 and the inlet pipe 12. At the end portions of the first pipe 19 and the third pipe 21 that are adjacent to the inlet pipe 12, as it is closer to the end portion of the inlet pipe 12 into which the exhaust gas flows, that is, with respect to a third pipe 21 side, the exhaust gas further easily flows. This ensures a muffler structure that centers on the reduction in exhaust noise in combination with the reduction in exhaust gas pressure.

Here, in deformation of the present invention, between the adjacent expansion chambers may be coupled by holes formed on the separators 14 and 15 not the pipes (the first pipe 19, the second pipe 20, and the third pipe 21). In this case, although the effect of the reduction in the exhaust gas pressure is obtained, the effect of the reduction in exhaust noise slightly decreases.

While the present invention has been described using various embodiments above, the present invention is not limited only to these embodiments. Changes and similar modification are possible within the scope of the present invention.

The present invention functions as an air exhausting device with respect to an engine mounted on another vehicle and the like similarly to the above description, not limited to the engine mounted on the motorcycle.

With the present invention, effects of reduction in exhaust gas pressure (increase in engine output) and reduction in exhaust noise are ensured at the same time.

What is claimed is:

1. An air exhausting device comprising:

an inlet pipe that couples an exhaust pipe of an engine to a muffler;

an outlet pipe that is a path to discharge an exhaust gas inside the muffler to outside air; and the muffler divided into a plurality of chambers by a separator, wherein:

the muffler is configured of:

a first expansion chamber;

a second expansion chamber with which the outlet pipe is communicated; and a third expansion chamber, the inlet pipe is communicated with the first expansion chamber, the outlet pipe is communicated with the second expansion chamber, the first expansion chamber is adjacent to and communicated with the second expansion chamber via a first pipe, the second expansion chamber is communicated with the third expansion chamber via a second pipe, and the first expansion chamber is communicated with the third expansion chamber via a third pipe, wherein in the first expansion chamber, a part of the exhaust gas flowing from the inlet pipe flows into the third expansion chamber through the third pipe, and the remaining part of the exhaust gas flows into the second expansion chamber in a first direction through the first pipe, in the third expansion chamber, the part of the exhaust gas flowing through the third pipe flows into the second expansion chamber in a second direction opposite to the first direction through the second pipe, in the second expansion chamber, the part of the exhaust gas flowing in the second direction through the second pipe, and the remaining part of the exhaust gas flowing in the first direction through the first pipe are both exhausted through the outlet pipe.

2. The air exhausting device according to claim 1, wherein:

on a cross section along a longitudinal direction of the muffler, the first pipe is adjacent to the second pipe such that distal ends of the first pipe and the second pipe overlap one another in the longitudinal direction inside the second expansion chamber, wherein a front end of the first pipe is closer to the exhaust pipe with respect to a front end of the outlet pipe.

3. The air exhausting device according to claim 1, wherein:

on a cross section along a longitudinal direction of the muffler, the first pipe and the second pipe are arranged at positions where distal ends of the first pipe and the second pipe are approximately faced to one another in the longitudinal direction inside the second expansion chamber, wherein a rear end of the second pipe is closer to the exhaust pipe with respect to a front end of the outlet pipe.

4. The air exhausting device according to claim 1, wherein:

on a cross section along a longitudinal direction of the muffler, the second pipe and the outlet pipe are arranged at positions where distal ends of the first pipe and the second pipe are approximately faced to one another in the longitudinal direction inside the second expansion chamber.

5. The air exhausting device according to claim 2, wherein:

on a cross section along a longitudinal direction of the muffler, the second pipe and the outlet pipe are arranged at positions where distal ends of the first pipe and the second pipe are approximately faced to one another in the longitudinal direction inside the second expansion chamber.

6. The air exhausting device according to claim 1, wherein:

on a cross section along a longitudinal direction of the muffler, the inlet pipe is adjacent to and between the third pipe and the outlet pipe, a difference in amounts of projection of an end portion of the third pipe and an end portion of the inlet pipe inside the first expansion chamber is smaller than a difference in amounts of projection of an end portion of the first pipe and an end portion of the inlet pipe inside the first expansion chamber.

7. The air exhausting device according to claim 1, wherein the third pipe is located closer to the inlet pipe than the first pipe in a longitudinal direction.

8. The air exhausting device according to claim 1, wherein the outlet pipe is located between the inlet pipe and the first pipe in a longitudinal direction.

* * * * *